United States Patent [19]

Junker

[11] Patent Number: 4,799,448

[45] Date of Patent: Jan. 24, 1989

[54] PORTABLE TRAFFIC MARKER

[76] Inventor: Wilhelm Junker, Reutlinger Strasse 14, D-1750 Backnang, Fed. Rep. of Germany

[21] Appl. No.: 55,389

[22] Filed: May 29, 1987

[30] Foreign Application Priority Data

May 31, 1986 [DE] Fed. Rep. of Germany ..... 3618404
May 9, 1987 [DE] Fed. Rep. of Germany ... 8706706[U]

[51] Int. Cl.[4] ..... E01F 9/01; E01F 9/02; G09F 15/00

[52] U.S. Cl. ..... 116/63 P; 40/607; 52/98; 52/298; 403/383

[58] Field of Search ..... 116/63 R, 63 P, 63 T, 116/173–175, 209; 40/606–608, 610, 612; 52/38, 98, 298; 248/346, 519, DIG. 10; 256/DIG. 5; 403/361, 383

[56] References Cited

U.S. PATENT DOCUMENTS 1,830,836 11/1931 Hager ..... 40/607
4,461,387 7/1984 Belokin, Jr. ..... 403/361

FOREIGN PATENT DOCUMENTS 7219360 5/1972 Fed. Rep. of Germany .
7934718 3/1980 Fed. Rep. of Germany .
8301856.5 7/1983 Fed. Rep. of Germany .
8434689.2 2/1985 Fed. Rep. of Germany .
3341647 5/1985 Fed. Rep. of Germany .
8535843.6 4/1986 Fed. Rep. of Germany .
1568657 6/1980 United Kingdom ..... 40/610

*Primary Examiner*—William A. Cuchlinski, Jr.
*Assistant Examiner*—Morris Worth
*Attorney, Agent, or Firm*—Foley & Lardner, Schwartz, Jeffery, Schwaab, Mack, Blumenthal & Evans

[57] ABSTRACT

In a portable traffic marker, the footplate has on its upper side a recess of rectangular or square outline in which the post is inserted. On the post either a portable traffic marker plate is fixed or a portable traffic marker body is fitted. The post has an M profile, the two mutually parallel side segments of which have the same length as each other, which is at least approximately the same as the inside diameter of the recess in the footplate. The two middle segments of the M profile are likewise of the same length and extend from the point of connection with the respective neighboring side segment at least approximately up to the middle of the line joining the free ends of the two side segments of the M profile.

20 Claims, 5 Drawing Sheets

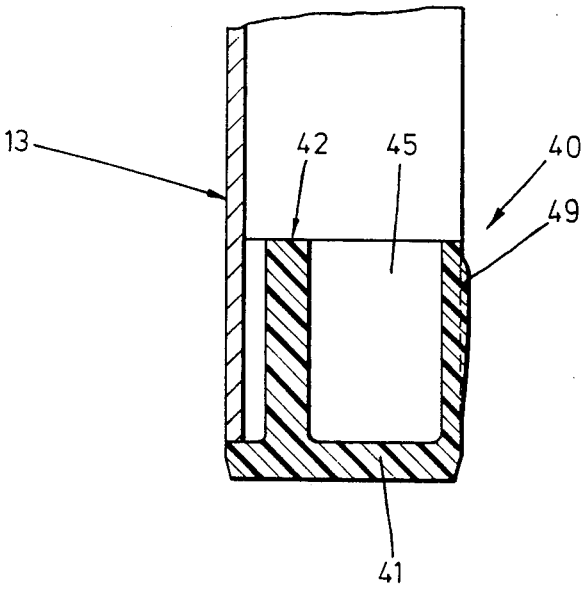
Fig. 7
Fig. 8
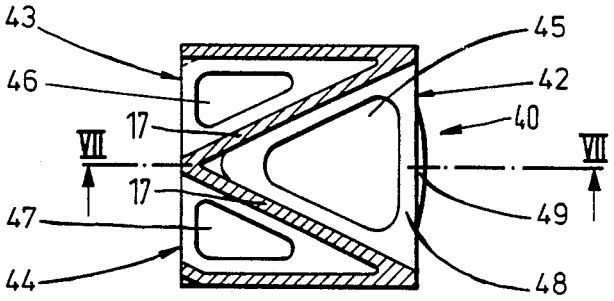

PORTABLE TRAFFIC MARKER

BACKGROUND OF THE INVENTION

A wide variety of portable traffic markers, as well as directional signs, prohibition signs, barriers and the like, are forever having to be put up temporarily on roads and in squares. Particularly at construction sites on highways and freeways, considerable numbers of portable traffic markers with or without additional traffic signs or lamps have to be put up close to one another, in order to create a visually continuous traffic control system at road sections branching from the usual traffic route. These portable traffic markers are generally fixed to stands, which are also known as footplate stands and which have a footplate, a post and a holder between the post and the footplate.

In conventional portable traffic marker stands, and, in particular those of older design, part of the holder on the footplate generally comprises a pocket of square cross-section. In metal footplates, the socket is formed by structural parts of the footplate and/or by welded-on steel rod sections. In the case of footplates of plastic and the like, the pocket is molded on the upper side of the footplate as a recess. The usually round portable traffic marker tube has at its lower end a rectangular foot adapted for insertion into the pocket. It is partially formed by welded-on steel rod sections. In another version of the portable traffic marker tube, the rectangular foot is formed by a plastic molding of cuboid shape with a round through-tube, into which the portable traffic marker tube is inserted and usually secured against twisting by a rivet.

The portable traffic marker tubes are generally designed as galvanized steel tubes which have a considerable section modulus against bending by virtue of their diameter and their wall thickness. If such a portable traffic marker stand is run over by a vehicle, the portable traffic marker tube is bent and usually even snapped off. Sometimes, the portable traffic marker tube is also torn out of the footplate and hurled away. In cases in which the portable traffic marker tube jams in the holder, the portable traffic marker tube exerts a leverage effect on the footplate on account of its high section modulus, with the result that the side of the footplate corresponding to the side of the portable traffic marker which is hit is lifted. In this situation the footplate may be thrust into the underside of the vehicle driving over it and cause serious damage to the front axle, and in particular, to parts of the steering and brake system. In addition, the vehicle may be deflected from its traveling direction so that it leaves the road or runs into oncoming traffic.

SUMMARY OF THE INVENTION

An object of the invention is to provide a portable traffic marker stand that reduces or eliminates the risk of the footplate lifting up when the portable traffic marker stand is run over.

As opposed to a conventional portable traffic marker tube, a post with an M profile has a sufficiently great section modulus against bending that, when subjected to bending forces such as, for instance, wind surges or the slipsteam of passing vehicles, the portable traffic marker plate, portable traffic marker body, or a traffic sign fixed on the post maintains its correct position. If such a portable traffic marker stand is run over and a relatively high lateral loading of the post is produced, the post is bent just above the footplate. At the point of bending, the segments of the M profile running partially parallel and partially at an angle to one another are brought closer together. In other words, the segments are folded together to a certain extent. This abruptly reduces the section modulus of the post against bending at this point to a much lower value, so that the post with the portable traffic marker plate or with the portable traffic marker body is folded over virtually as in a joint, without the footplate lifting up significantly in the process. In this way, the vehicle can drive over the portable traffic marker stand unhindered, without the risk that the footplate will hook onto the underside of the vehicle and/or be thrust into it. Admittedly, after such an accident, the post does have to be replaced. However, the costs for this are far less than the costs which would arise for if the footplate were to be lifted up and thrust into the underside of the vehicle.

One embodiment of the portable traffic marker stand is of particular interest for retrofitting existing portable traffic marker stands having replaceable footplates. Another embodiment of the portable traffic marker stand is of interest in particular for those portable traffic marker stands in which the footplate fully matches the profile of the post with the M profile.

In a third embodiment, an adaptor is provided on the stand which provides additional hold where parts of the adaptor protrude into the gaps between the individual segments of the M profile of the post. This embodiment functions so that when there is a relatively high lateral loading of the post and there is an incipient bending process in the length section of the post taken up by the adaptor, the segments of the post are held in their original spaced positions so that the post does not snap over in the recess of the footplate and thereby loosen the fitting of the post. Instead, the post is held firmly in the adaptor, and thus in the recess of the footplate, and the bending or snapping-off process takes place outside the holder.

In a fourth embodiment of the portable traffic marker stand, a similar result is achieved for posts in the case of footplates with a continuous downward recess.

In a fifth embodiment, the adaptor on the foot of the post is dimensioned in the direction of the bulge to be greater than the inside diameter of the recess in the footplate. The fact that the adaptor part with the bulge is provided on the inside with an axial recess which is open at the face gives the wall part with the bulge an increased bending elasticity. When a post with such an adaptor is inserted, the wall part with the ramp-shaped recess is elastically inwardly deformed to an increasing extent. The elastic restoring force of this wall part is subsequently continuously maintained, so that this adaptor exerts a considerable clamping force between the post and the footplate. This means that such a post has a very firm fit in the footplate, making additional fastenings superfluous and resulting in a portable traffic marker stand which is not only cheaper, but which can also be fitted and removed faster.

In a sixth embodiment of the invention, a reliable, durable connection of the adaptor with the post is provided which likewise requires no further fastenings.

In a seventh embodiment, reinforcing elements are arranged at a certain distance above the end section inserted in the footplate, making the end profile of the post into a full profile, and substantially increasing the section modulus in this length section. In particular, when the reinforcing elements are fitted on a portable traffic marker stand such as provided by the sixth embodiment at the level at which the portable traffic marker stand is usually hit by the bumper of a car, the reinforcing elements ensure that no second bending point is produced at the place of impact of the bumper. Additionally, the reinforcing elements ensure that parts of the post, the portable traffic marker plate, the portable traffic marker body, a traffic sign or other traffic control components above the point of force application are not bent backward to thereafter recoil against the advancing vehicle and damage the vehicle. Such a design of the portable traffic marker stand is particularly advantageous if relatively high impact speeds and resultant high acceleration are expected with corresponding relatively high forces of inertia.

In an eighth embodiment, the reinforcing elements are fixed relatively simply to the post, thereby ensuring a durable connection between the reinforcing elements and the post if the post is elastically deformed or is plastically deformed within certain limits.

In a ninth embodiment, both the deformation resistance of the post against denting and the section modulus of the post against bending are greatly increased without the mass of the post being increased very much in the region of bending.

In a tenth embodiment, the connection rigidity of the post is increased. This embodiment reduces the risk of injuries during handling of the post while facilitating the insertion of the post into the recess of a baseplate if the adaptor is designed as in the fifth embodiment and has a ramp-shaped bulge. If the tenth embodiment is shaped in such a way that the reinforcing elements and their end plate are designed the same as the adaptor in the fifth embodiment, the same plastics molding can be used for both ends of the post. This considerably reduces the costs for the production and stocking of these parts.

In accomplishing the foregoing objects, there has been provided according to the present invention a portable traffic marker comprising a marker plate; a footplate having a generally rectangular receiving portion; means for securing a post in the receiving portion; and a post for supporting the marker plate, the post being made of metal or plastic and having two opposed, generally parallel longitudinal side segments and two longitudinal middle segments, each of the middle segments being joined along a back longitudinal edge to a respective back longitudinal edge of one of the side segments and extending from the back longitudinal edge to a front longitudinal edge located at approximately the mid-point of a line between the front longitudinal edges of the side segments, the middle segments being joined to each other along their front longitudinal edges, whereby the cross-sectional profile of the side and middle segments generally resembles an M and whereby the post resists bending when subjected to lateral loads from such forces as wind surges or vehicle slipstreams while bending readily when subjected to higher lateral loads from such forces as the impact of a vehicle.

In a preferred embodiment, the generally rectangular receiving portion is a recess and the bottom of the recess is formed with raised portions which define an M profile closely corresponding to the M profile of the post.

In another preferred embodiment, the invention further comprises an adaptor receivable in the generally rectangular receiving portion and having spaced raised portions on its upper surface which form recesses therebetween, the recesses merging into one another and defining an M profile generally corresponding to the M profile of the post, the adaptor adapted to receive the post in the recesses; and fastening means for fastening the adaptor in the generally rectangular receiving portion.

Further objects, features and advantages of the present invention will become apparent from the detailed description of preferred embodiments which follows, when considered together with the attached figures of drawing.

BRIEF DESCRIPTION OF THE DRAWINGS

The invention will be explained in more detail below with reference to an exemplary embodiment represented in the drawing, in which:

FIG. 7 is a vertical section of a further modified embodiment of the adaptor taken along line VII—VII in FIG. 8;

FIG. 8 is a plan view of the adaptor shown in FIG. 7 with a horizontal section of the associated post;

DETAILED DESCRIPTION OF THE PREFERRED EMBODIMENTS

Figure 1:
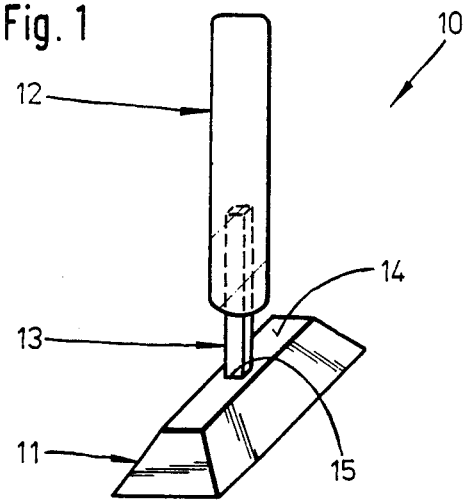
FIG. 1 is a perspective view of a portable traffic marker according to the invention, with footplate, post and portable traffic marker body.

The portable traffic marker stand 10 which can be seen as a whole in FIG. 1, has a footplate 11, a portable traffic marker body 12 and a post 13.

The footplate 11 has a rectangular outline. It is roughly shaped like a roof, in which the ridge area is flattened off. It may, however, also be shaped differently, for example,like a flat elongated cube. In the flat upper side 14 of the footplate 11, generally in the middle, there is a recess 15, which is usually of square outline. In some portable traffic marker stands of this type, the recess 15 is designed as a through-hole, while in others the recess is designed as a blind hole. This recess 15 forms part of the holder for the post 13.

The portable traffic marker body 12 is designed as a hollow body which is of lenticular of rectangular outline at its lower end. The portable traffic marker body 12 has a rectangular cross-sectional shape at its upper closed end, which is generally narrower than the outline at the lower end. In the embodiment with a lower lenticular outline, the side areas of the portable traffic marker body merge smoothly with the upper cross-sectional shape. In the embodiment with rectangular lower base area, the two flat side areas are inclined slightly relative to each other.

At the lower end, the portable traffic marker body 12 has in the middle of its base area a throughhole which matches the shape and dimensions of the post 13. Ther are additional guiding and/or retaining elements for the post 13 in the region of this through-hole and/or inside the hollow portable traffic marker body 12. There is often also a transversely running through-hole in the portable traffic marker body 12 and in the post 13, into which hole a retaining or securing pin is inserted, by which the two parts are firmly held against each other.

Figure 2:
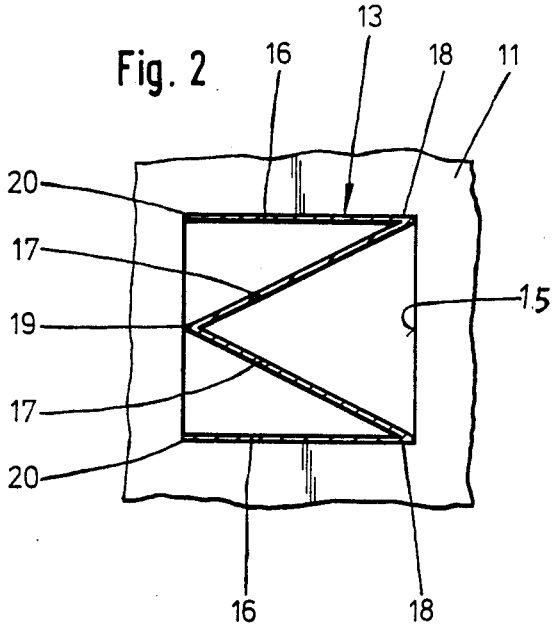
FIG. 2 is a side view of the two sides of the post of the portable traffic marker aligned transversely with respect to the footplate.

The post 13 is made of metal, generally, a lightweight metal extruded section. It has an M profile, as can be seen in FIG. 2. The two side segments 16 of the M profile are aligned in parallel with each other. They are of the same length, which is at least approximately equal to their outside distance apart. The length of the side segments 16 and their outside distance apart depend on the shape and the inside diameter of the recess 15 in the footplate 11. If the recess 15 is not of a square outline, but of a rectangular outline, the side segments 16 must match the length of the side walls which are aligned transversely to the longitudinal extent of the footplate 11. The two middle segments 17 of the M profile are arranged in the shape of a V and are designed in such a way that they extend from the point of connection 18 with their respective neighboring side segments to at least approximately the center of the line joining the free ends 20 of the two side segments 16. This construction ensures that at least the V-shaped portion of the M profile formed by the two middle segments always remains in the middle of the recess 15, because the triangle formed by them bears against the side walls of the recess 15 at their point of connection 19 and at the points of connection 18, or at least at the adjoining part of the two side segments 16.

FIG. 2 shows the M profile of the post 13 with sharp edges. Particularly at the point of connection 19 of the two middle segments 17, the profile shape may be flattened off somewhat on the outside and rounded off somewhat on the inside. Such flattening and rounding can be done to the points of connection 18 between each of the side segments 16 and one of the middle segments 17. If the post 13 is not a lightweight metal extruded section, but is instead a sheet metal folded profile, rounded zones of the M profile occur anyway at the transitions from a side segment to the adjoining middle segment or between the two middle segments, but these rounded zones should be minimized as much as possible.

Figure 3:
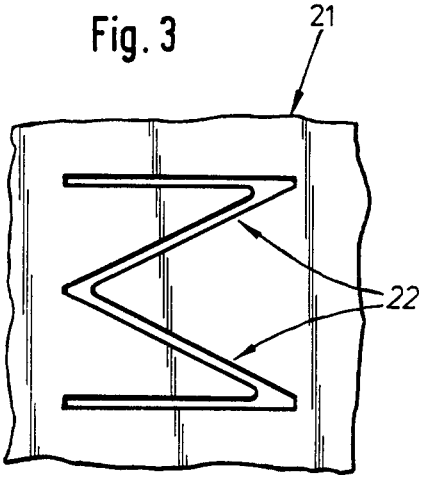
FIG. 3 is a side view of the two sides of the post of the portable traffic marker aligned transversely with respect to the footplate.

In the case of the modified embodiment of the portable traffic marker stand shown in section in FIG. 3, the footplate 21 has a recess 22 which for its part has an M-shaped outline as a mating counterpart to the M profile of the post 13. This outline mates with the post 13 in such a way that the end section of the post 13 can be inserted in the recess 16 and has as firm a fit as possible in it. This close matching occurs in particular in those regions of the recess 22 which receive the side segments 16 and middle segments 17 of the post 13. At the points of connection 18 between side segment 16 and the neighboring middle segment 17 and also at the junction point 19 of the two middle segments 17, the recess 16 may be designed with its outline having greater rounded zones in order to facilitate the insertion of a post 13. All in all, even a very general approximation of the outline of the recess 16 to the M profile of the post 13 produces a very good hold of all profile parts of the post 13.

In the case of footplates having a square or rectangular outline, a similar close guidance of the profile parts of the post 13 and the resultant good hold of the post 13 in the footplate are achieved by an adaptor 23 inserted in the recess 15 having an outer shape and dimensions which closely match the shape and dimensions of the recess 15. This adaptor 23 has a lateral recess 24 on each of two opposite sides and, in its middle region, a middle recess 25. The recesses are perpendicularly aligned, merge one into the other and represent at least approximately a mating counterpart to the M profile of the post 13. As already mentioned, with this arrangement it is possible to have relatively large rounded zones on the insides of the transitions between two profile parts and corresponding deviations of the delimiting walls of the recesses 24 and 25 with respect to the standard geometric shape of the M profile.

Outside the base areas of the recesses 24 and 25 and inside the contours of the recess 15 of the footplate 11 there remain on the adaptor 23 three column-like or pin-like adaptor parts 26, 27 and 28 of triangular-shaped base area. The two adaptor parts 26 and 27 are symmetrical. The adaptor part 28 has a shape which approximates that produced by the rear surfaces of the joined adaptor parts 26 and 27.

Figure 5:
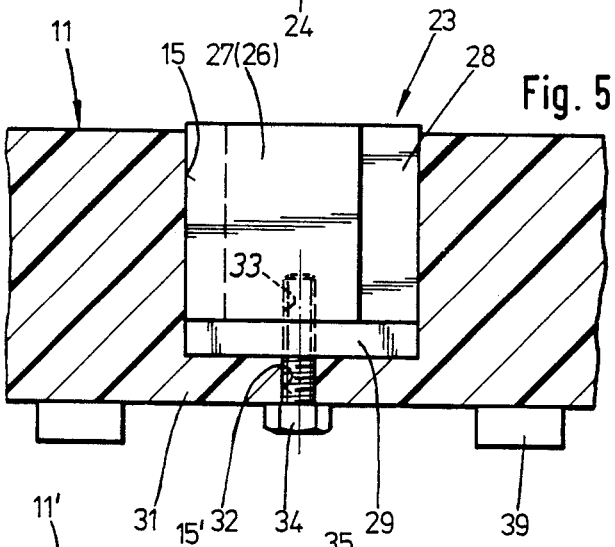
FIG. 5 is a side view of the middle reinforcing element shown in FIG. 4.

The three adaptor parts 26, 27, 28 are produced as one piece together with a baseplate 29 (FIG. 5). This baseplate 29 has a base area which closely matches the outline of the recess 15 of the footplate 11 and therefore ensures a good fit of the adaptor 23 in the recess 15. In addition, the adaptor 23 can be secured by fitting a fastening screw 34 through a through-hole 32 in the bottom part 31 of the footplate 11 which forms the bottom of the recess 15, and through a threaded hole 33, in the form of a blind hold, in the adaptor 23.

Figure 4:
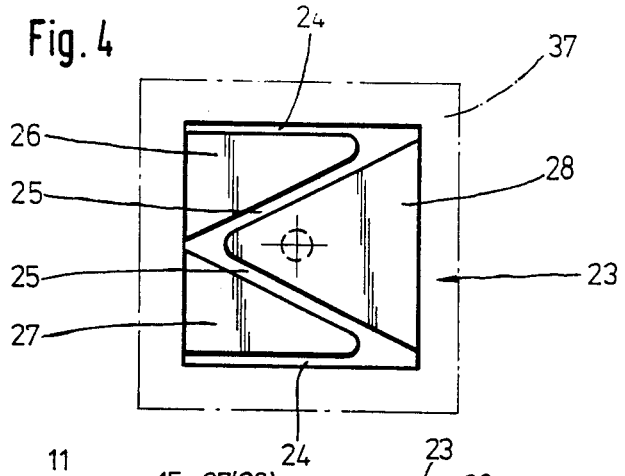
FIG. 4 is a partially sectional plan view and a horizontal section of each of three reinforcing elements of the post.
Figure 6:
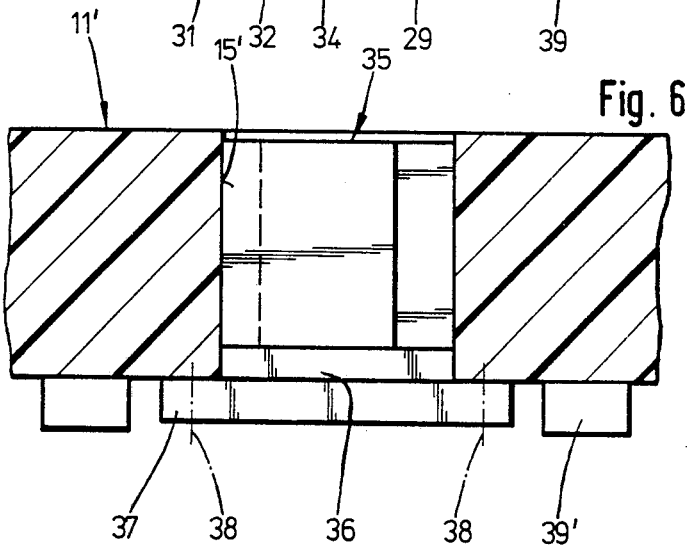
FIG. 6 is a side view of the middle reinforcing element shown in FIG. 4.

In the case of footplates 11' in which the recess 15' for the post 13 is designed as a throughhole, or in which there is any other relatively large passage, a modified adaptor 35, which can be seen in FIG. 6, is used. Its outline is the same as the adaptor 23 (FIG. 4) or at least the same as the outline of the passage. The baseplate 36 of the modified adaptor joining the adaptor parts together is provided with an encircling collar 37, which is indicated in FIG. 4 by dot-dash lines. This collar 37 projects beyond the contour of the recess 15'. At at least two diametrically opposed points, there are fastening means, such as, for instance, fastening screws 38, which are indicated in FIG. 6 by dotdash lines and which are fitted through a corresponding through-hole in the collar 37 and screwed into a threaded blind hole on the underside of the footplate 11'. This ensures that the adaptor 35 cannot be pushed out inadvertently when inserting a post 13 if its fit in the recess 15' is not very tight.

In the embodiments of the portable traffic marker stand 10 with an adaptor according to FIGS. 5 or 6, it is assumed that the footplate 11 and 11′ is provided on its underside with feet 39 and 39′, by virtue of which there is adequate clearance for the head of the fastening screw 34 or for the collar 37 on the baseplate 36 on the underside of the footplate. In the event that there is no such clearance, the fastening screw 34 would have to be designed as a countersunk scrw or a recess would need to be provided for it on the underside of the footplate 11. Similarly, a corresponding recess would have to be provided on the underside of the footplate 11′ for the collar 38. In the latter case, it would also suffice if, instead of an encircling collar 37, individual collar sections, like tabs, are molded on the adaptor 35 to fit in recesses on the underside of the footplate 11′ which have only a slightly larger base area than the tabs.

The adaptor 40, which can be seen in FIGS. 7 and 8, for the post 13 has a number of modified features in comparison with the adaptor 23 (FIGS. 4 and 5). The three column-like or pin-like adaptor parts 42, 43 and 44, between which the post 13 with the M profile can be inserted, as molded to the continuous baseplate 41, the outline of which is approximately the same as the outline of the recess 15 of the footplate 11. The middle adaptor part 42, with the outline of an equilateral triangle, is provided on the inside with an axial recess 45, which extends from the baseplate 41 up to the open face of the adaptor 40. The adaptor parts 43 and 44 are each provided with similar recess 46 and 47, respectively.

The outside wall 48 of the adaptor part 42 can elastically bend in the direction of the inside of the recess 45. Molded on the outside of the outside wall 48 is a bulge 49, which extends approximately from the baseplate 41 up to just below the free face of the adaptor 40 and is built up in this direction. The projection of the bulge 49 is at its smallest in the region of the baseplate 41 and at its greatest in the region of the open face away from the baseplate 41. Its cross-sectional area is bow-shaped, as can be seen in FIG. 8.

The bulge 49 on the adaptor part 42 acts like a wedge when the adaptor 40 is inserted together with the post 13 into the recess 15 of the footplate 11. As the adaptor 40 is pushed deeper into the recess 15, the outside wall 48 increasingly elastically deforms inwards. The restoring force thereby induced in the outside wall 48 acts as a clamping force between the adaptor 40 and footplate 11, the post 13 also being firmly clamped at the same time because the adaptor 12 bears against its middle segments 17.

Generally speaking, the clamping force generated by the bulge 49 on the outside wall 48 is adequate to provide the adaptor 40, and thus the post 13, with a firm fit in the recess 15 of the footplate 11. In the event that this is not sufficient on account of the footplate 11 being of a relatively nonrigid material, the adaptor parts 43 and 44 could also be provided with similar bulges as the bulges 49.

As a further exemplary embodiment, FIGS. 9–14 will now be referred to to explain a portable traffic marker stand 50 with a post which is additionally modified. The reference numbers of this portable traffic marker stand 50 correspond to the reference numbers of the portable traffic marker stand 10 shown in FIGS. 1 and 2 in according to the relationship that each new reference number is equal to 40 plus the reference number from FIGS. 1 and 2.

Figure 9:
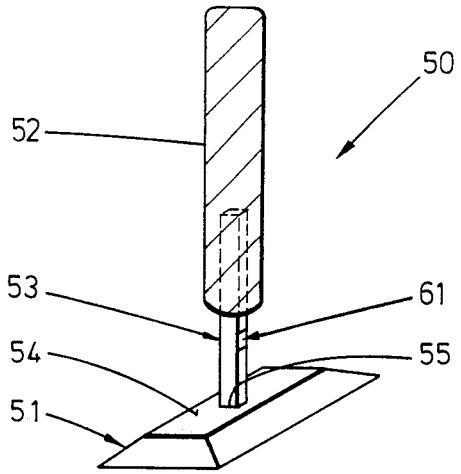
FIG. 9 is a perspective view of a modified exemplary embodiment of the portable traffic marker.

As indicated in FIG. 9, reinforcing elements are arranged on the post 53 at a certain length section, and, consequently, at a certain height above the ground. Of these, one reinforcing element 61 can be seen in FIGS. 9 and 10 and both reinforcing elements 62 can be seen in FIG. 11.

Figure 12:
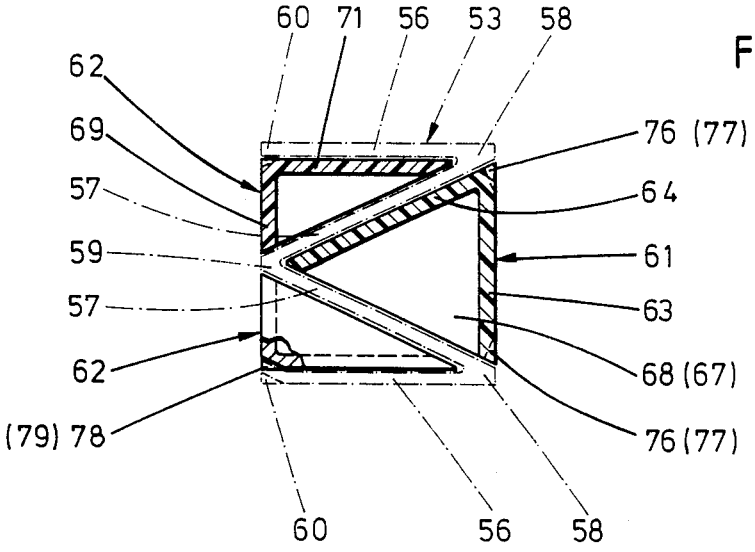
FIG. 12 is a partially sectional plan view and a horizontal section of each of three reinforcing elements of the post shown in FIG. 9.

As indicated in FIG. 12, the reinforcing elements 61 and 62 match the cavities of the M profile of the post 53 in such a way that they make the profile into a full profile. The outline projection of the reinforcing element 61 is an equilateral triangle. The outline projection of the two reinforcing elements 62 is a right-angled triangle, which is at least approximately the same as half the outline projection of the reinforcing element 61.

Figure 13:
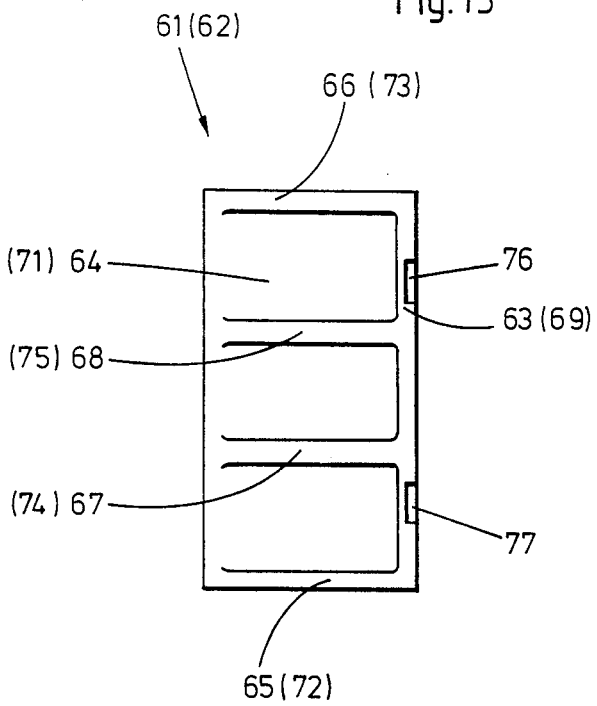
FIG. 13 shows a side view of the middle reinforcing element shown in FIG. 12.

The reinforcing elements 61 and 62 are plastic moldings. The reinforcing element 61 has along the narrow side of its outline a wall 63, along one of the longitudinal sides of its outline a wall 64 and at each of both faces a wall 65 and 66 (FIG. 13). After reinforcing element 61 is fit on a post 53, the open side of the reinforcing element 61 is closed by its neighboring segment 57. The cavity of the reinforcing element 61 within the walls is subdivided by a rib or by a number of ribs 67 and 68, which are aligned at right angles to the longitudinal extent of the reinforcing element 61 and at right angles to the longitudinal axis of the post 53. The ribs 67 and 68 extend from the walls 63 and 64 up to the longitudinal side of the triangular outline of the reinforcing element 61, so that their outer edge can lie alongside the entire length of the middle segment 57 of the post 53.

The reinforcing elements 62 have on their narrow side the wall 69, on the one longitudinal side running at right angles thereto the wall 71 and at each of their faces a wall 72 and 73, respectively. Their cavities are likewise subdivided by two ribs 74 and 75, as is the case with the reinforcing element 61. The vertical projections parallel to the wall 69 of the reinforcing elements 62 consequently resemble the corresponding vertical projections of the reinforcing element 61, which can be seen in FIGS. 5 and 6.

In the case of the reinforcing element 61, there are in each case a pair of recesses 76 and 77 on the narrower wall 63 in the region of their face walls 65 and 66, or at least in their proximity, close to the two outside edges. In the case of the reinforcing elements 62, there is in each case only one recess 78 or 79 at the right-angled edge. These recesses 76–79 are used for fixing the reinforcing elements 61 and 62 to a post 53. For this purpose, in the region of one of these recesses, a small length section is plastically deformed from the neighboring edge of the M profile and thus into the corresponding recess. In this way the reinforcing elements 61 and 62 are firmly held in the M profile of the cavity both in the transverse direction of the post 53 and in its longitudinal direction. This positive fixing has the advantage that the connection between the reinforcing elements 61 and 62 and the post 53 is still ensured even in cases where the post 53 is elastically deformed or where it is permanently deformed, within certain limits.

Figure 10:
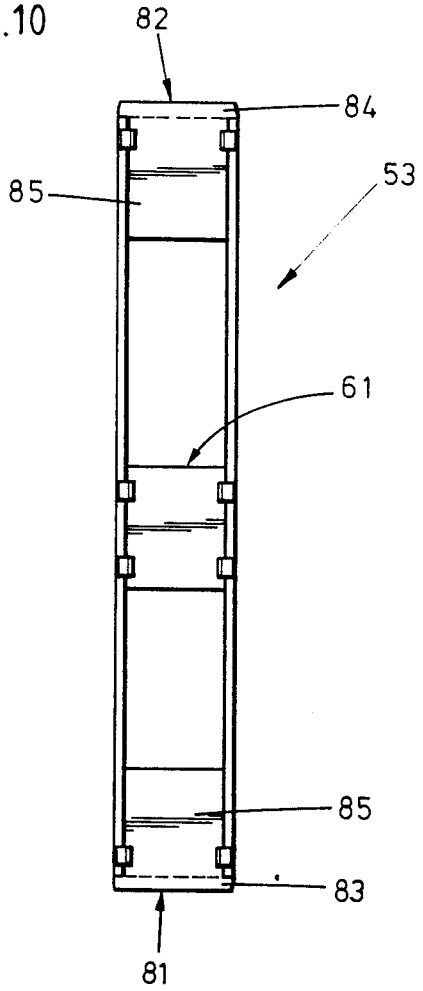
FIG. 10 is a side view of the two sides of the post shown in FIG. 9, aligned transversely with respect to the footplate.
Figure 11:
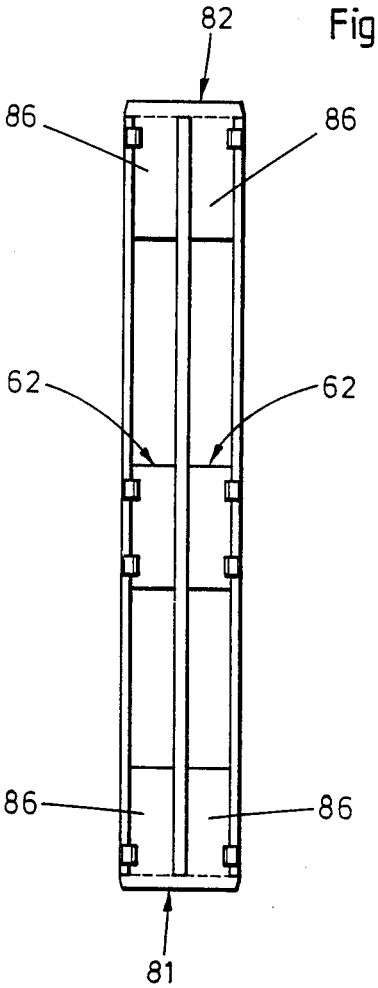
FIG. 11 is a side view of the two sides of the post shown in FIG. 9, aligned transversely with respect to the footplate.
Figure 14:
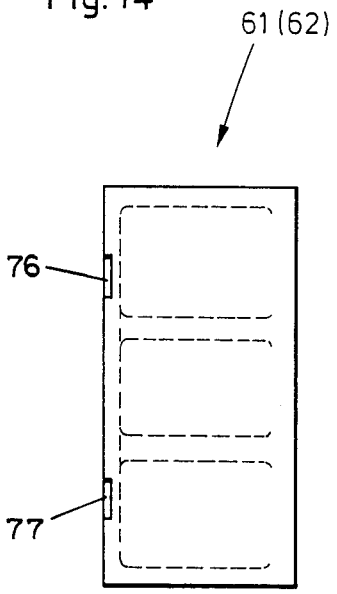
FIG. 14 shows a side view of the middle reinforcing element shown in FIG. 12.

As can be seen in FIGS. 10 and 11, the post 53 is provided at its lower end with an adaptor 81 which is designed the same as the adaptor 40 (FIGS. 7 and 8). The upper end of the post 53 is topped off by a cap 82, which is likewise designed the same as the adaptor 40. This cap 82 increases the torsional rigidity of the upper part of the post 53. In addition, it reduces the risk of injury which may otherwise occur when handling the post with sharpedged M profile ends. The adaptor 81 and the cap 82, like the adaptor 40, each have one columnar adaptor piece 85 and two columnar adaptor pieces 86. The adaptor pieces are connected to one another by means of a plate 83 or 84. The adaptor 81 and the cap 82 are secured to the post 53 in the same way as the reinforcing elements 61 and 62 by small length sections of the edges of the M profile of the post 53 being bent into corresponding recesses on the adaptor 81 and on the cap 82.

What is claimed is:

1. A portable traffic marker comprising:

a marker plate;

a footplate having a generally rectangular receiving portion;

means for securing a post in said receiving portion;

a post for supporting said marker plate, said post being made of metal or plastic and consisting essentially of two opposed, generally parallel longitudinal side segments and two longitudinal middle segments, each of said middle segments being joined along a back longitudinal edge to a respective back longitudinal edge of one of said side segments and extending from said back longitudinal edge to a front longitudinal edge located at approximately the mid-point of a line between the front longitudinal edges of said side segments, said middle segments being joined to each other along their front longitudinal edges, whereby the cross-sectional profile of said side and middle segments generally resembles an M and whereby said post resists bending when subjected to lateral loads from such forces as wind surges or vehicle slipstreams while bending readily when subjected to higher lateral loads from such forces as the impact of a vehicle.

2. A portable traffic marker as claimed in claim 1, wherein the generally rectangular receiving portion is a recess and the bottom of the recess is formed with raised portions having grooves therebetween thereby defining an M profile closely corresponding to the M profile of said post.

3. A portable traffic marker as claimed in claim 1, wherein said means for securing said post comprises:

an adaptor receivable in said generally rectangular receiving portion and having spaced raised portions on its upper surface which form recesses therebetween, said recesses merging into one another, said rectangular receiving portion and said recesses defining an M profile generally corresponding to the M profile of said post, said adaptor adapted to receive said post in said recesses; and fastening means for fastening said adaptor in said generally rectangular receiving portion.

4. A portable traffic marker as claimed in claim 3, wherein said generally rectangular receiving portion comprises a through-hole and said adaptor comprises a lower portion extending downwardly beyond said through-hole and having at least one collar section projecting sideways along the underside of said footplate and fastening means for fastening said collar section to said footplate.

5. A portable traffic marker as claimed in claim 1, wherein said means for securing said post comprises an adaptor attachable to said post, said adaptor comprising a base with column-like adaptor parts, wherein at least one of said parts of said adaptor forms an outer side of said adaptor and defines a longitudinally extending, open ended recess and said outer side is provided with an outwardly projecting, ramp shaped bulge tapering in a downward direction.

6. A portable traffic marker as claimed in claim 1, wherein said means for securing said post comprises an adaptor attachable to said post, said adaptor having generally an M-profile formed by adaptor recesses, wherein the M profile formed by said adaptor recesses corresponds to an M having at least one free leg bent slightly inward and wherein a corresponding side segment of said post is deformed to be received within said bent free leg of said M profile.

7. A portable traffic marker as claimed in claim 1, wherein said post further comprises a reinforcing element extending between said two middle segments and between each of said middle segments and its joined side segment, respectively.

8. A portable traffic marker as claimed in claim 7, wherein said reinforcing elements are positioned along a longitudinal portion of said post whose lowest point is approximately the same height above the ground as the height of a bumper of a motor vehicle.

9. A portable traffic marker as claimed in claim 7, wherein said post further comprises fastening means for fastening said reinforcing elements to said post and said fastening means includes recesses formed in said reinforcing elements for receiving projecting portions of adjacent side segments of said post.

10. A portable traffic marker as claimed in claim 7, wherein each of said reinforcing elements further includes reinforcing ribs extending generally perpendicular to the longitudinal extent of said reinforcing element.

11. A portable traffic marker as claimed in claim 1, further comprising a cap covering the top of said post.

12. A portable traffic marker as claimed in claim 1, wherein each of said side segments is approximately the same width as the width of said generally rectangular receiving portion.

13. A portable traffic marker as claimed in claim 5, wherein said adaptor is pre-inserted into the lower end of said post.

14. A portable traffic marker as claimed in claim 13, further comprising means for fastening said adaptor in the lower end of said post, including a recess formed in said adaptor and a portion of said side segment received in said recess.

15. A portable traffic marker support comprising:

a footplate having a generally rectangular receiving portion;

means for securing a post in said receiving portion;

a post for supporting a marker plate, said post being made of metal or plastic and consisting essentially of two opposed, generally parallel longitudinal side segments and two longitudinal middle segments, each of said middle segments being joined along a back longitudinal edge to a respective back longitudinal edge of one of said side segments and extending from said back longitudinal edge to a front longitudinal edge located at approximately the midpoint of a line between the front longitudinal edges of said side segments, said middle segments being joined to each other along their front longitudinal edges, whereby the cross-sectional profile of said side and middle segments generally resembles an M and whereby said post resists bending when subjected to lateral loads from such forces as wind surges or vehicle slipstreams while bending readily when subjected to higher lateral loads from such forces as the impact of a vehicle.

16. A portable traffic marker as claimed in claim 15, further comprising an adaptor receivable in said generally rectangular receiving portion and having spaced raised portions on its upper surface which form recesses therebetween, said recesses merging into one another and defining an M profile generally corresponding to the M profile of said post, said adaptor adapted to receive said post in said recesses.

17. A portable traffic marker as claimed in claim 16, wherein at least one of said raised portions of said adaptor forms an outer side of said adaptor and defines a longitudinally extending, open ended recess and said outer side is provided with an outwardly projecting, ramp shaped bulge tapering in a downward direction.

18. A portable traffic marker as claimed in claim 17, wherein said adaptor is pre-inserted into the lower end of said post.

19. A portable traffic marker as claimed in claim 18, further comprising means for fastening said adaptor in the lower end of said post, including a recess formed in said adaptor and a portion of said side segment received in said recess.

20. A portable traffic marker as claimed in claim 15, wherein said post further comprises a reinforcing element extending between said two middle segments and between each of said middle segments and its joined side segment, respectively.

* * * * *